United States Patent [19]

Blumer

[11] Patent Number: 4,848,679

[45] Date of Patent: Jul. 18, 1989

[54] CRUSHER

[76] Inventor: Eldon D. Blumer, P.O. Box 156, Kalispell, Mont. 59903

[21] Appl. No.: 163,707

[22] Filed: Feb. 22, 1988

[51] Int. Cl.[4] ..... B02C 1/10

[52] U.S. Cl. ..... 241/84; 241/95; 241/164; 241/262; 241/263; 241/283

[58] Field of Search ..... 241/94, 84, 164, 262, 241/263, 264, 265, 266, 267, 268, 269, 283, 83, 84.3, 95, 156, 165, 79

[56] References Cited

U.S. PATENT DOCUMENTS

| | | | |
|---|---|---|---|
| 15,179 | 8/1821 | Michaelsen . | |
| 122,832 | 1/1872 | Hope | 241/164 X |
| 239,626 | 4/1881 | Sharp | 241/164 X |
| 1,053,220 | 2/1913 | Ribeyron . | |
| 2,485,718 | 10/1949 | Ebersol . | |
| 2,554,697 | 5/1951 | Conway | 241/95 X |
| 2,707,081 | 4/1955 | Schmidtmann . | |
| 2,751,158 | 6/1956 | Fisher | 241/94 X |
| 2,772,053 | 11/1956 | Schmidtmann . | |
| 2,843,331 | 7/1958 | Reeves | 241/264 X |
| 3,414,203 | 12/1968 | Bodine . | |
| 4,272,032 | 6/1981 | Hellberg | 241/263 |

FOREIGN PATENT DOCUMENTS

| | | | |
|---|---|---|---|
| 466911 | 7/1975 | U.S.S.R. | 241/264 |
| 923592 | 4/1982 | U.S.S.R. | 241/79 |

*Primary Examiner*—Joseph M. Gorski

*Attorney, Agent, or Firm*—Kolisch, Hartwell & Dickinson

[57] ABSTRACT

A crusher with opposed jaw members that relatively reciprocate in a substantially linear path to crush material. The jaw members have stepped cruching faces, and a step in a crushing face is defined by a crushing expanse delineated by the front surfaces of spaced bars in a grid assembly. Pivoted arms may be employed to mount a movable jaw member.

3 Claims, 3 Drawing Sheets

CRUSHER

BACKGROUND AND SUMMARY OF THE INVENTION

This invention relates to crushers usable in the crushing of materials such as rock, ore and the like, to produce crushed material of substantially reduced particle size. The invention has particular utility, and will be described herein, in the context of a crusher usable in the crushing of granite or basalt to produce gravel and fine material for the paving of roads and other surfaces. It is not intended by this description, however, to be limited to such a particular use of the apparatus.

Various types of crushers are known in the industry. Describing generally more common types of crushers, such include what might be referred to as a cone crusher, which includes a cone, usually rotated in an eccentric path, and working against an opposing support surface, to produce granulation. So-called roll crushers feature opposed rolls which are rotated to cause material to pass between the nip of the rolls producing a crushing action. So-called jaw crushers typically include opposed jaws with inclined crushing surfaces that pivot toward and away from each other, many times with an eccentric type of movement, to produce a crushing action.

A problem which has characterized many known types of crushers is an inability to handle efficiently a wide range of rock sizes. Further explaining, if the rock to be pulverized is in pieces of too large a size, many of the more common crushers will not accept such material, meaning that such must be preliminarily processed to reduce the material to such a size as to be accepted by the crusher. This is disadvantageous, of course, since it requires, in effect, multiple crushers, resulting in an increased capital outlay and introducing material handling problems. In other crushers, there is a problem of having the material work efficiently through the crusher during the crushing operation. For instance, in many jaw-type crushers, the construction is such that the crusher tends to work material upwardly against the flow of incoming material, impeding the flow of material through the crusher. With larger crushers, this is a more severe problem, because of the divergence required in the jaws at their upper extremities if the jaws are to receive product of large size. Crushers which utilize an oscillatory motion, where the crushing surfaces slide across each other, tend to be prone to wear problems by reason of the abrasive action produced by the rock under such a sliding action.

A general object of this invention is to provide an improved crusher which avoids or minimizes many of the above indicated problems characterizing prior art devices.

A more specific object is to provide an improved crusher which is capable of handling a wide range of material sizes.

Another object is to provide a crusher which includes a pair of opposed jaw members mounted for relative reciprocal movement toward and away from each other with such occurring in a substantially linear path.

Another object is to provide such a crusher where the jaw members have opposed, stepped, crushing face means, with plural opposed step portions of increasingly closer spacing progressing downwardly between the jaw members.

In a related object, a crusher is provide wherein each step portion is fronted by a crushing expanse extending substantially normal to the path of movement of a jaw member.

Another object is to provide such a crusher where the step portions in a jaw member are fronted by substantially vertical crushing expanses, and each such expanse is formed by the front surfaces of laterally spaced bars forming a grid in the crusher.

Another object is to provide a crusher wherein a jaw member is mounted on pivoted upstanding arms, which pivot at points spaced vertically from the path of movement of the jaw member, to provide in the jaw member a substantially lineal movement.

BRIEF DESCRIPTION OF THE DRAWINGS

These and other objects and advantages are attained by the invention, which is described hereinbelow in conjunction with the accompany drawings, wherein.

DETAILED DESCRIPTION OF A PREFERRED EMBODIMENT

Figure 1:
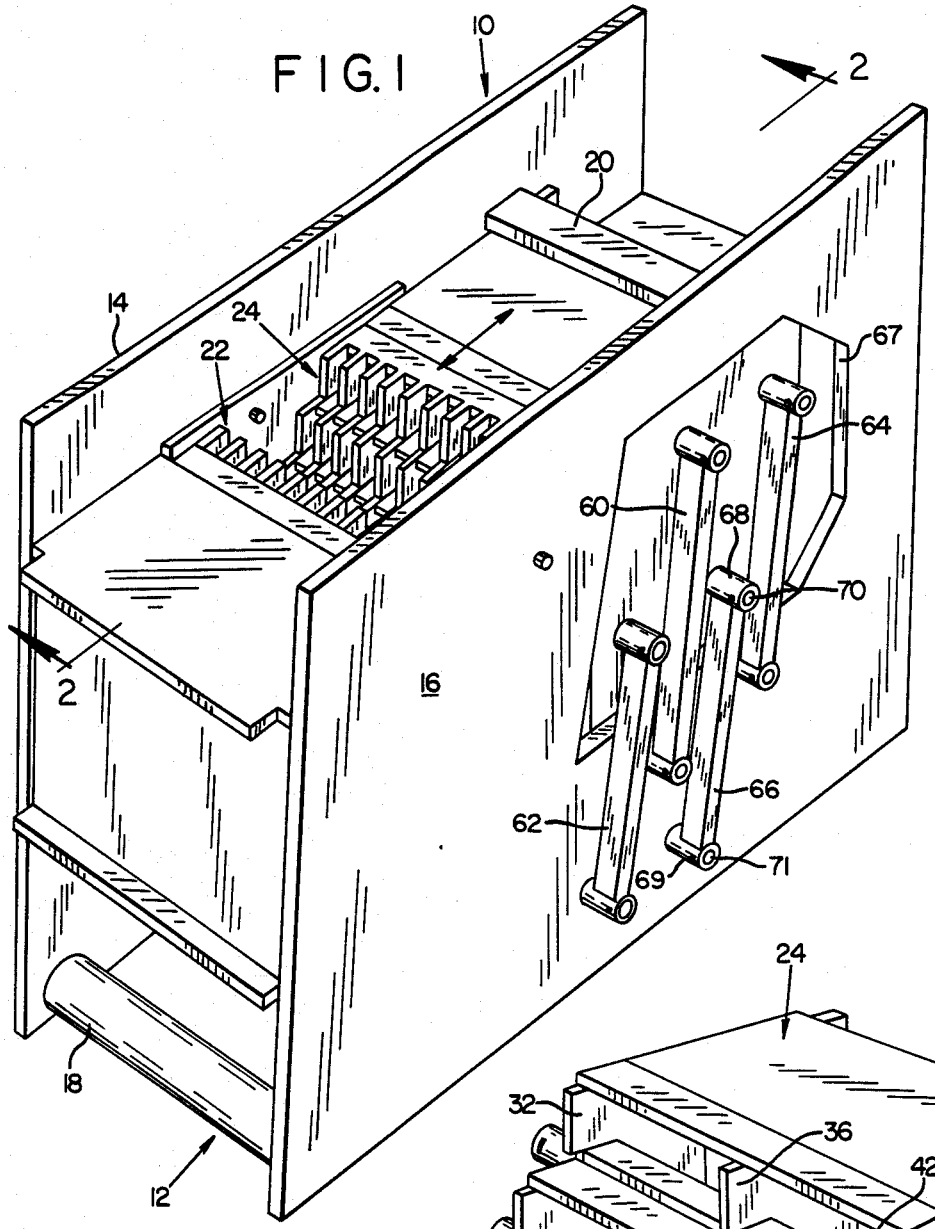
FIG. 1 is a perspective view, illustrating a crusher constructed according to a preferred embodiment of the invention.
Figure 2:
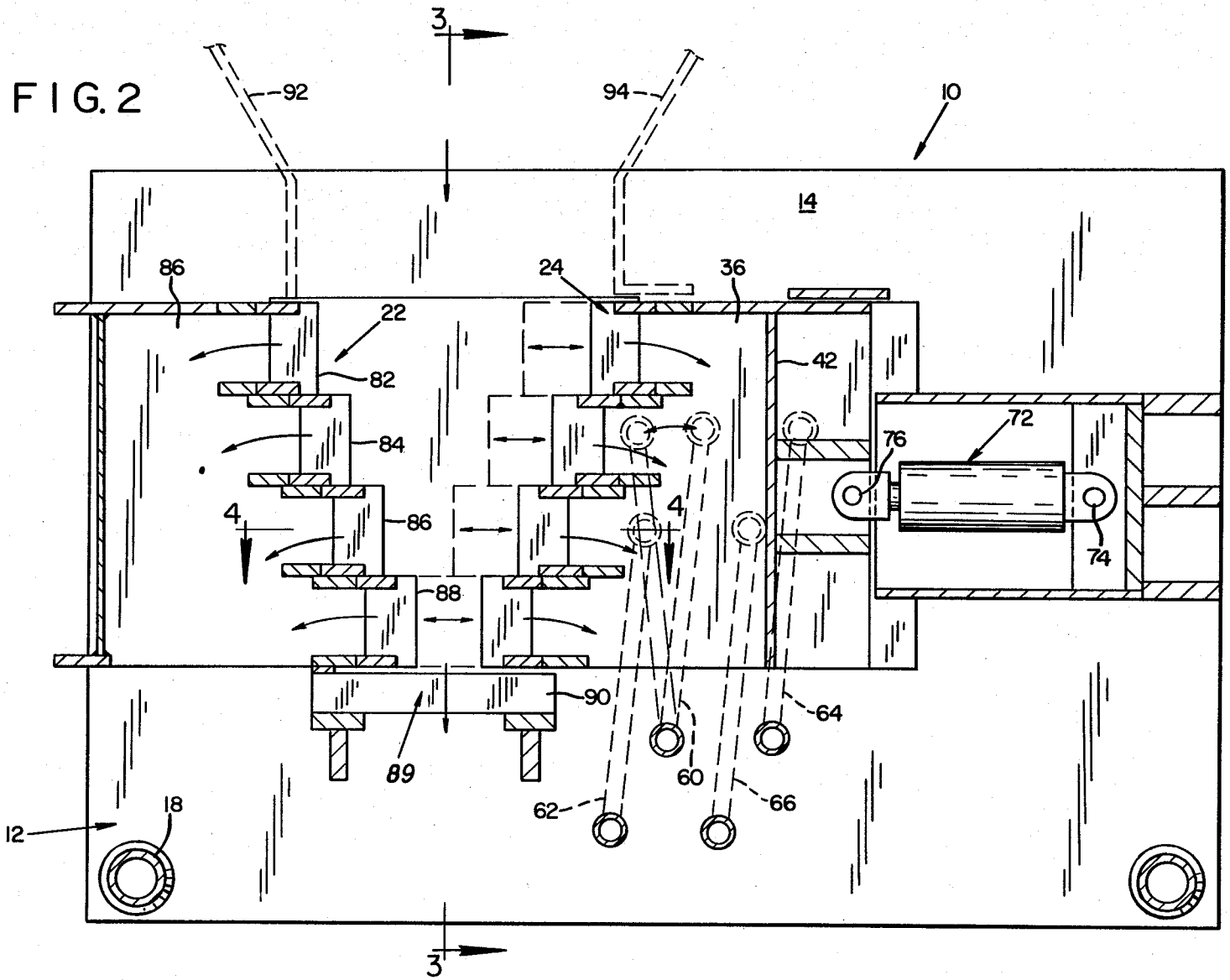
FIG. 2 is a cross-sectional view of the crusher illustrated in FIG. 1, taken generally along the line 2—2 in FIG. 1.
Figure 3:
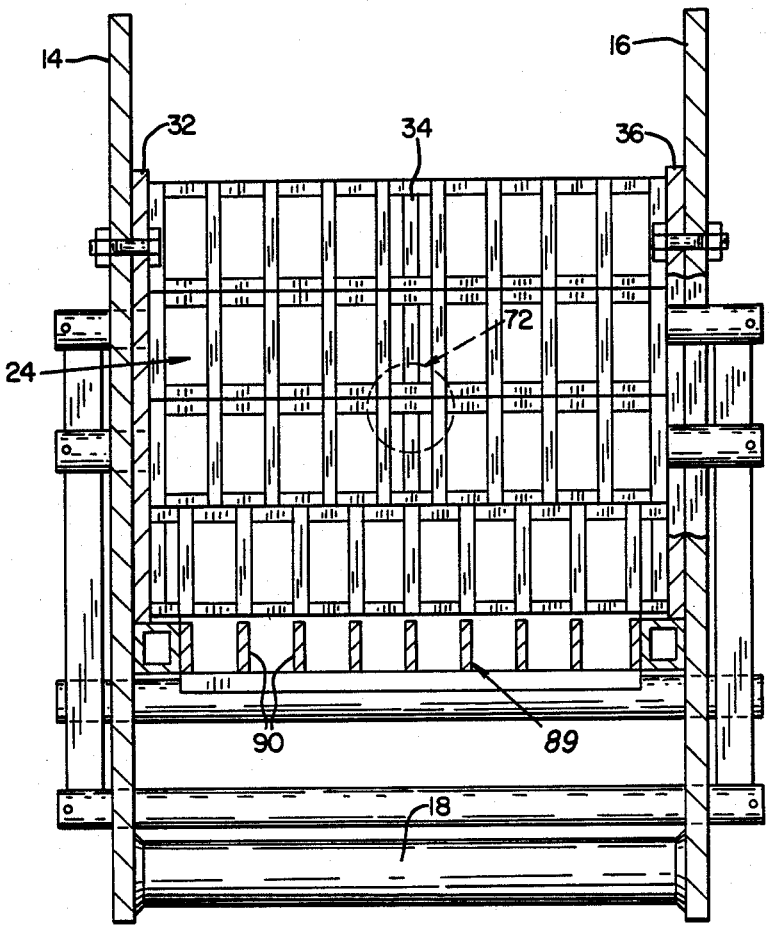
FIG. 3 is a cross-sectional view, taken generally along the line 3—3 in FIG. 2.

Referring now to the drawings, and more particularly to FIGS. 1 and 2, the crusher indicated generally at 10 includes a frame 12 including opposed upstanding side plates 14, 16 joined together to form a rigid unit, as by means including cross elements 18 and bars 20.

The crusher includes a pair of opposed jaw members designated generally at 22 and 24. In the particular embodiment of the invention illustrated, jaw member 22 is fixed in position, whereas jaw member 24 is mounted for horizontal reciprocal movement in substantially a linear path toward and away from jaw member 22. If desired, and in some modifications of the invention, both jaw members may be mounted for such reciprocal movement. With either construction, the jaw members are relatively movable toward and away from each other during a cycle of operation.

Figure 6:
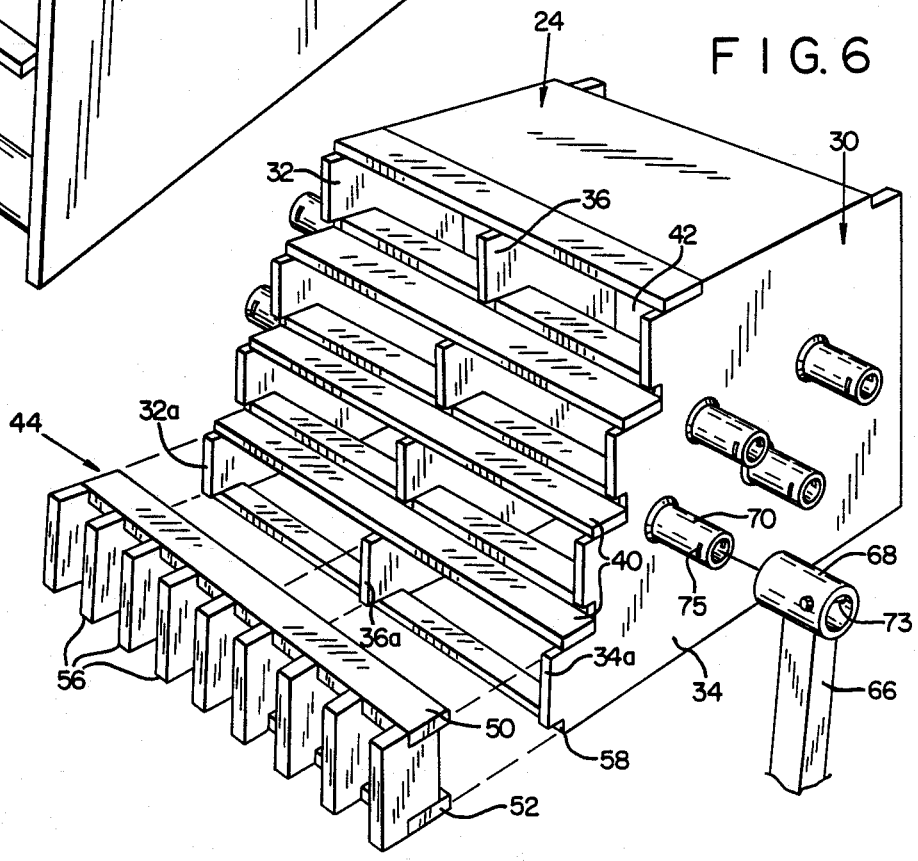
FIG. 6 is a perspective view of a jaw member, illustrating further details of the construction.

Considering the construction of a jaw member, and initially the construction of jaw member 24, and with reference now also to FIG. 6, the jaw member includes what is referred to herein as a jaw member frame 30 made up of opposed side plates 32, 34 and a center plate 36, each having a stairstep-type profile forming the margin of the plate which extends toward the viewer in FIG. 6. Joining these plates together, with the plates vertically disposed and parallel, are bars, such as cross bars 40, and a vertical mounting plate 42. Details of construction may vary, but the construction selected is one that provides requisite rigidity and strength to the jaw member.

Figure 5:
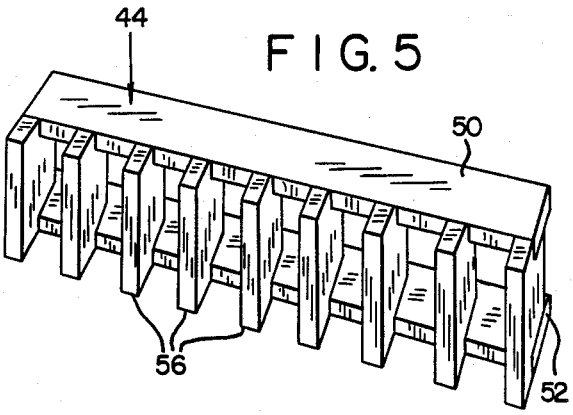
FIG. 5 is a perspective view, illustrating a grid assembly such as may be used to form one of the steps in a jaw member face.

Jaw member 24 has a stepped crushing face means provided along the side thereof which faces jaw member 22, which is the side facing toward the viewer and to the left in FIG. 6. This crushing face means is formed by forwardly facing surfaces of a grid assembly, such as grid assembly 44 shown in FIGS. 5 and 6, which is mounted against and disposed forwardly of each set of riser surfaces in the side plates and center plates, such as, for instance, riser surfaces 32*a*, 34*a*, and 36*a* delineating the forward edges of the lowermost step outlined byplates 32, 34, 36.

Describing a grid assembly, and referring to the assembly 44 shown in FIG. 6, such comprises a pair of bar sections 50, 52 which extend across and connect vertically extending bar pieces 56. Describing a particular construction which has worked effectively, these bar pieces might have a thickness of ¾", a lateral spacing in the assembly of approximately 2", and a length of approximately 4". With these dimensions, a crushing expanse is formed by the forwardly facing surfaces of these bar pieces having a depth of approximately 4".

A grid assembly is mounted in place, with bar section 50 against a cross bar 40, bar section 52 fitting within notches such as notch 58 provided in the plates 32, 34, 36, and the back edges of the bar pieces against riser surfaces 32*a*, 34*a*, 36*a*.

A grid assembly similar to the one described is mounted forwardly of each step region member defined in plates 32, 34, 36. As illustrated in FIG. 6, therefore, there would be four such grid assemblies mounted on the jaw member shown.

Jaw member 24, and referring to FIGS. 1 and 2, is mounted on the frame of the crusher utilizing elongate upstanding pivot arms, as exemplified by arms 60, 62, 64 and 66, which are located on the side of the crusher located toward the viewer in FIG. 1. A similar set of arms is provided on the opposite side of the crusher. Side plates 14, 16 of the frame are cut away, as at 67, to expose the sides of the jaw member. The arms have sleeves, such as sleeve 68, at their upper ends, which are journaled on journals 70 connected to the subframe of the jaw member, to provide a pivot mounting. Similar sleeves 69 at the lower ends of the arms fit about similar journals 71 on the side plates. With the arms mounted to pivot about journals 71 which are spaced a substantial vertical distance below the jaw member, the jaw member in effect in moving back and forth moves in substantially a lineal path. With a jaw member, for instance, moved 6" in shifting from a retracted to an extended position, the crusher may be constructed so that the upper ends of the arms move 3", then pass an over center position, and another 3" to effect this stroke movement. Bolts 73 on the sleeves extending through slots 75 on the journals hold the arms from external outward displacement.

Powering movement of the jaw member back and forth is a fluid operated ram such as hydraulic ram 72 (see FIG. 2), having its cylinder end suitably pivotally connected at 74 to the frame of the crusher, and its rod suitably pivotably connected as at 76 to the jaw member frame at the rear of the jaw member. To effect 6" movement in the jaw member the ram would have a 6" stroke.

Jaw member 22 may have a construction similar to jaw member 24, save that this jaw member may be mounted in a fixed position in the crusher. Like jaw member 24, jaw member 22 has grid assemblies, as exemplified by those shown at 82, 84, 86, 88 see FIG. 2), with front surfaces of bars in these grid assemblies forming the crushing expanses of the step portions in the jaw member. As illustrated in FIG. 2, frame 86 of jaw member 22 may be secured in place on the frame of the crusher as by welding.

Figure 4:
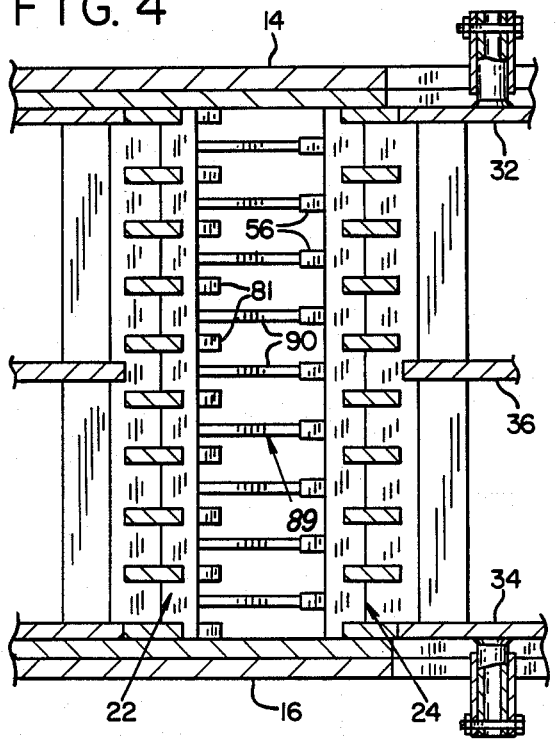
FIG. 4 is a cross-sectional view, taken generally along the line 4—4 in FIG. 2.

Ordinarily, the vertical bar pieces in the grid assemblies of jaw member 22 would have the same thickness and lateral spacing as those in the grid assemblies of the other jaw member. In a typical crusher, the bar pieces in the grid assemblies of jaw member 22 are directly opposite the bar pieces of the grid assemblies in jaw member 24, save for the bar pieces in the lowermost grid assemblies in the respective jaw members. In this instance, the bar pieces may have a staggered relationship, as illustrated in FIG. 4, where bar pieces 56 of the lowermost grid assembly in jaw member 24 occupy planes that are midway between the planes of the bar pieces 81 in the lowermost grid assembly of jaw member 22.

It is contemplated in the particular crusher illustrated that the spacing between the crushing expanses in the lowermost grid assemblies with the jaw members apart be, for instance, 6". With the hydraulic ram fully extended, the crushing expanses occupy substantially a common plane. With the crushing expanse of each step portion in a jaw member being set back 3" from the crushing expanse of the step portion below it, it follows that with the crushing expanses of the lowermost step portions of the two jaw members against each other, the crushing expanses of the step portions in the next step of the two jaw members would lie 6" apart, the crushing expanses of the next step 12" apart, etc.

Underneath the jaw members a floor is provided designated generally at 89. This floor also is a grid assembly comprising multiple bar pieces 90 suitably joined to the frame of the crusher disposed parallel to each other and spaced, as are the bar pieces of the grid assemblies, some 2" apart, the bar pieces having the same width, i.e., a ¾" width, as the other bar pieces.

To aid in channeling material into the crusher adjacent the top of the crusher, deflectors may be provided, such as those shown in dashed outline in FIG. 2 at 92, 94.

Describing how the crusher may be utilized, material is fed into the crusher by gravity, with such flowing into the space between the jaw members. As the material flows between the jaw members, and with jaw member 24 reciprocated back and forth in its mounting, the various crushing expanses of the step portions in the jaw members first relatively move toward each other, to come up against and then to press against the material, causing such to break apart, this movement being followed by release of the material. As the material is reduced in size, such falls downwardly in the crusher to be processed by crushing expanses in lower step portions of the jaw members. As material is reduced in size and on such being broken up, that which can easily pass through the spacing between the bar sections of the various grid assemblies passes through the crush face means of the crusher to fall downwardly in the apparatus. In the last stage of the crusher, i.e., in that region bounded by the lowermost grid assemblies, material is either forced through the grid assemblies of the crusher jaw members or else falls downwardly through the floor. A conveyor may be provided to collect material falling downwardly from the crusher.

Explaining a typical run, and assuming, for instance, that granite or basalt is being crushed having a size of 16" on down, some 70% of the material passing through the crusher will 50–60% passes through a #10 screen, i.e., a screen having ten holes per square inch, equating to coarse sand. The 30% of larger material (between ¾" and 2" in size) is conveniently rerun through the crusher together with new material.

With the crusher of the invention, crushing is performed rapidly with minimal wear on the parts. The relative simplicity of the crusher contributes to low maintenance requirements.

While a specific embodiment of the invention has been described, this has been for illustration purposes. Modifications and variations are possible without departing from the invention.

It is claimed and desired to secure by Letters Patent:

1. In a crusher for processing material including a supporting frame:

a pair of opposed jaw members and mounting means mounting the jaw members on said frame with the jaw members being relatively reciprocatable in a substantially lineal crushing path between relatively extended and relatively contacted positions with the distance moved by the jaw members between these positions being the throw of the jaw members, each jaw member having a crushing face means defined by multiple step portions with each step portion in one jaw member being opposed by a step portion in the other jaw member and the opposed step portions of the jaw members having increasingly closer spacing there between progressing downwardly between the jaw members, the lowermost opposed step portions in the jaw members with the jaw members having a relatively extended position being spaced apart a given distance, each step portion of each jaw member being fronted by a crushing expanse extending substantially normal to the crushing path, and each step portion comprising a grid of the bars being laterally spaced from each other a distance exceeding the thickness of the bars and this distance being one third of the throw of said jaw members, the lateral spacing between the bars being voids and these voids extending through the grid for the travel between the bars of crushed material, forwardly facing surfaces of the bars forming the crushing expanse of each step portion, and a perforate floor disposed under said lowermost opposed step portions constructed to permit the passage therethrough of material having a predetermined size or smaller but inhibiting the passage there through of material of larger size, said predetermined size being less than the spacing between the lowermost opposed step portions of the jaw members with the jaw members in their relatively extended position, material processed by the crusher passing through the grids of the various step portions and the perforate floor under the lowermost step portions.

2. The crusher of claim 11, which further includes power-operated means for relatively reciprocating the jaw members in said path and said power-operated means comprises a fluid-operated ram interposed between a jaw member and said frame which is extensible and contractible in a path which follows said crushing path.

3. The crusher of claim 11, wherein the floor comprises a grid composed of horizontal equally laterally spaced bars with voids therebetween for the travel between the bars of crushed material.

* * * * *